US012173960B2

(12) United States Patent
Cho et al.

(10) Patent No.: US 12,173,960 B2
(45) **Date of Patent: *Dec. 24, 2024**

(54) REFRIGERATOR

(71) Applicant: SAMSUNG ELECTRONICS CO., LTD., Suwon-si (KR)

(72) Inventors: Sungjun Cho, Suwon-si (KR); Hyekyoung An, Suwon-si (KR); Jonghyun Son, Suwon-si (KR); Sangmin Park, Suwon-si (KR); Jin Jeong, Suwon-si (KR); Yangyeol Gu, Suwon-si (KR); Yongman Seo, Suwon-si (KR); Woochul Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/383,369

(22) Filed: Oct. 24, 2023

(65) Prior Publication Data

US 2024/0053093 A1 Feb. 15, 2024

Related U.S. Application Data

(63) Continuation of application No. 17/188,237, filed on Mar. 1, 2021, now Pat. No. 11,828,527.

(30) Foreign Application Priority Data

Feb. 28, 2020 (KR) ..... 10-2020-0025170

(51) Int. Cl.
*F25C 5/00* (2018.01)
*F25C 5/20* (2018.01)
(Continued)

(52) U.S. Cl.
CPC ..... *F25D 23/126* (2013.01); *F25C 5/22* (2018.01); *F25D 23/028* (2013.01); *F25C 2400/10* (2013.01)

(58) Field of Classification Search
CPC ..... F25D 23/068; F25C 5/22; F25C 2400/10
See application file for complete search history.

(56) References Cited

U.S. PATENT DOCUMENTS 5,787,724 A 8/1998 Pohl et al.
6,868,692 B2 3/2005 Choi
(Continued)

FOREIGN PATENT DOCUMENTS

DE 10 2010 039 379 A1 3/2011
EP 2 357 435 A2 8/2011
(Continued)

OTHER PUBLICATIONS

European Search Report dated Sep. 29, 2022, issued in European Application No. EP 21 76 1210.
(Continued)

*Primary Examiner* — Filip Zec
(74) *Attorney, Agent, or Firm* — STAAS & HALSEY LLP

(57) ABSTRACT

Disclosed herein is a refrigerator. The refrigerator includes a body provided to form a storage compartment, a door rotatably mounted on the body, a dispenser provided in the door, an ice maker located in the storage compartment, a dispenser hose provided to be connectable to the dispenser, an ice maker hose provided to be connectable to the ice maker, and a hose guide located inside the door to accommodate the dispenser hose and the ice maker hose.

5 Claims, 12 Drawing Sheets

(51) Int. Cl.
*F25D 23/02* (2006.01)
*F25D 23/12* (2006.01)

(56) References Cited

U.S. PATENT DOCUMENTS

| | | | | |
|---|---|---|---|---|
| 7,287,555 | B2 | 10/2007 | Heger | |
| 8,371,138 | B2 | 2/2013 | Choi | |
| 9,115,930 | B2 | 8/2015 | Park | |
| 9,303,913 | B2 | 4/2016 | Ha | |
| 9,328,954 | B2 | 5/2016 | Kang et al. | |
| 9,618,250 | B2 | 4/2017 | Park | |
| 9,683,771 | B2 * | 6/2017 | Anselmino | F25C 5/182 |
| 9,791,197 | B2 | 10/2017 | Choi | |
| 9,982,932 | B2 * | 5/2018 | Lindel | F25D 25/005 |
| 10,119,747 | B2 * | 11/2018 | You | F25D 23/04 |
| 10,365,026 | B2 * | 7/2019 | Jeong | F25C 5/22 |
| 10,837,690 | B2 * | 11/2020 | Scalf | F25C 5/182 |
| 2010/0147007 | A1 | 6/2010 | Froelicher et al. | |
| 2011/0056222 | A1 | 3/2011 | Lee et al. | |
| 2013/0305771 | A1 | 11/2013 | Kim | |
| 2014/0230481 | A1 | 8/2014 | Yun et al. | |
| 2015/0159934 | A1 | 6/2015 | Choi et al. | |
| 2016/0223251 | A1 | 8/2016 | Yun | |
| 2016/0370102 | A1 | 12/2016 | Yang | |
| 2017/0051963 | A1 | 2/2017 | Root | |
| 2017/0167780 | A1 * | 6/2017 | Jeong | F25D 11/02 |
| 2017/0174493 | A1 * | 6/2017 | Aranda | B67D 3/02 |
| 2017/0292751 | A1 * | 10/2017 | Lee | F25C 5/22 |
| 2018/0023882 | A1 | 1/2018 | Jeong et al. | |
| 2019/0331386 | A1 | 10/2019 | Yang | |
| 2020/0041191 | A1 | 2/2020 | You et al. | |

FOREIGN PATENT DOCUMENTS

| | | | |
|---|---|---|---|
| EP | 3 273 192 | A1 | 1/2018 |
| EP | 3 406 992 | A1 | 11/2018 |
| KR | 1997-0022171 | A | 5/1997 |
| KR | 20-0157107 | Y1 | 9/1999 |
| KR | 2000-0011251 | U | 6/2000 |
| KR | 10-0728340 | B1 | 6/2007 |
| KR | 10-2010-0053978 | | 5/2010 |
| KR | 10-1548263 | B1 | 8/2015 |
| KR | 10-1561349 | B1 | 10/2015 |
| KR | 10-1626981 | B1 | 6/2016 |
| KR | 10-1733241 | B1 | 5/2017 |
| KR | 10-1798542 | B1 | 11/2017 |
| KR | 10-2019-0010310 | A | 1/2019 |
| KR | 10-2186837 | B1 | 12/2020 |
| WO | WO 2008/005564 | A2 | 1/2008 |

OTHER PUBLICATIONS

PCT International Search Report for Application No. PCT/KR2021/002195 dated Jun. 17, 2021.
Office Action dated Dec. 22, 2022 issued in U.S. Appl. No. 17/188,237.
Notice of Allowance dated May 29, 2023 issued in U.S. Appl. No. 17/188,237.
Office Action dated Apr. 26, 2023 issued in U.S. Appl. No. 17/188,237.
Lee, "Piping Structure of device for picking up drinking in refrigerator", Jun. 13, 2007; Espacenet; description (Year: 2007).
Notice of Allowance dated Aug. 2, 2023 issued in U.S. Appl. No. 17/188,237.
U.S. Appl. No. 17/188,237, filed Mar. 1, 2021, Sungjun Cho, Samsung Electronics Co., Ltd.
Office Action dated Apr. 16, 2024, issued in European Application No. 21 761 210.0.

* cited by examiner

REFRIGERATOR

CROSS-REFERENCE TO RELATED APPLICATION(S)

This application is a continuation of application U.S. Ser. No. 17/188,237, filed Mar. 1, 2021, and is based on and claims priority under 35 U.S.C. § 119 to Korean Patent Application No. 10-2020-0025170, filed on Feb. 28, 2020, in the Korean Intellectual Property Office, the disclosures of which are incorporated by reference herein in their entireties.

BACKGROUND

1. Field

The disclosure relates to a refrigerator, and more particularly, to a refrigerator including a water supply system.

2. Description of Related Art

Generally, a refrigerator is an apparatus configured to keep foods fresh at a low temperature by supplying cold air at a low temperature to a storage compartment in which the food is stored.

The refrigerator may be classified according to the shape of a storage compartment and a door, and thus the refrigerator may be classified into a top mounted freezer (TMF) type in which a storage compartment is divided up and down by a horizontal partition to form a freezing compartment on the upper side and a refrigerating compartment on the lower side, and a bottom mounted freezer (BMF) type refrigerator in which a refrigerating compartment is formed on the upper side and a freezing compartment is formed on the lower side. Further, the refrigerator may include a side by side (SBS) type refrigerator in which a storage compartment is partitioned left and right by a vertical partition, and a freezing compartment is formed on one side, and a refrigerating compartment is formed on the other side, and a French door refrigerator (FDR) in which a storage compartment is divided up and down by a horizontal partition, a refrigerating compartment is formed on the upper side, a freezing compartment is formed on the lower side, and the refrigerating compartment on the upper side is opened and closed by a pair of doors.

The refrigerator may include an ice maker configured to make ice, and a dispenser provided to extract water from the front of a door without opening the door. A water supply hose for supplying water to the ice maker or the dispenser may be provided on the door of the refrigerator.

SUMMARY

Therefore, it is an aspect of the disclosure to provide a refrigerator capable of replacing a water supply hose provided in a door even after the door is filled with an insulating material.

It is another aspect of the disclosure to provide a refrigerator capable of reducing material cost.

It is another aspect of the disclosure to provide a refrigerator capable of improving a cleanliness of a dispenser.

Additional aspects of the disclosure will be set forth in part in the description which follows and, in part, will be obvious from the description, or may be learned by practice of the disclosure.

In accordance with an aspect of the disclosure, a refrigerator includes a body forming a storage compartment, a door rotatably mounted on the body to open or close the storage compartment, a dispenser in the door, an ice maker in the storage compartment, a dispenser hose that is connectable to the dispenser, an ice maker hose that is connectable to the ice maker, and a hose guide, inside the door, through which the dispenser hose is insertable to be guided to the dispenser to be connected to the dispenser, and in which the dispenser hose, when connected to the dispenser, is accommodated, and through which the ice maker hose is insertable to be guided to the ice maker to be connected to the ice maker, and in which the ice maker hose, when connected to the ice maker, is accommodated.

The hose guide may include a guide inlet portion through which the dispenser hose and the ice maker hose are insertable to guide the dispenser hose and the ice maker hose, a dispenser guide portion branched from the guide inlet portion to guide the dispenser hose but not the ice maker hose, and an ice maker guide portion branched from the guide inlet portion to guide the ice maker hose but not the dispenser hose.

The refrigerator may further include a hinge that rotatably supports the door, the guide inlet portion may be coupled to the hinge.

The dispenser guide portion may include a hose accommodating portion forming a space to allow the dispenser hose to be withdrawn from the dispenser guide portion by a predetermined length.

The hose accommodating portion may be formed to have an inner cross-sectional area greater than an inner cross-sectional area of the guide inlet portion.

The hose accommodating portion may include a contraction preventing portion that protrudes from an outer surface of the hose accommodating portion.

The dispenser hose may include a dispenser connecting portion that is fixable to the dispenser. The hose accommodating portion may include a first accommodating portion in which the dispenser hose becomes located in response to the dispenser connecting portion being withdrawn from the dispenser guide portion by a first length, and a second accommodating portion in which the dispenser hose becomes located in response to the dispenser connecting portion being withdrawn from the dispenser guide portion by a second length that is less than the first length.

The hose guide may be fixed to the dispenser.

The hose guide may include a first coupling portion screwed to one portion of the dispenser, and a second coupling portion hooked to another portion of the dispenser.

The door may include an insulating material surrounding the hose guide.

The dispenser may include a connecting member having one end connected to the dispenser hose, and a cock removably coupled to an other end of the connecting member opposite to the one end of the connecting member.

The connecting member may include a cock fixing member to fix the cock by an elastic force.

The connecting member may include a first hose fixing member to fix the dispenser hose by an elastic force, and a second hose fixing member configured to release the dispenser hose in response to the second hose fixing member being pressed toward a direction opposite to a direction from which the dispenser hose is released from the connecting member.

The dispenser may include an ice guide to which the connecting member is mounted, to guide ice from the ice maker.

The dispenser may include a dispenser cover to which the ice guide is removably coupled.

In accordance with another aspect of the disclosure, a refrigerator includes a body forming a storage compartment, a door to open and close the storage compartment, a dispenser in the door, and a dispenser hose that is connectable to the dispenser. The dispenser includes a connecting member having one end connectable to the dispenser hose, and a cock removably coupled to an other end of the connecting member opposite to the one end of the connecting member.

The connecting member may include a first hose fixing member to fix the dispenser hose by an elastic force, and a second hose fixing member configured to release the dispenser hose in response to the second hose fixing member being pressed toward a direction opposite to a direction from which the dispenser hose is released from the connecting member.

The connecting member may include a cock fixing member to fix the cock by an elastic force.

The cock may be formed of stainless steel.

In accordance with another aspect of the disclosure, a refrigerator includes a body forming a storage compartment, a door rotatably mounted on the body to open and close the storage compartment, a dispenser in the door, an ice maker in the storage compartment, a dispenser hose that is connectable to the dispenser, an ice maker hose that is connectable to the ice maker, and a hose guide, inside the door, through which the dispenser hose is insertable to be guided to the dispenser to be connected to the dispenser, and in which the dispenser hose, when connected to the dispenser, is accommodated, and through which the ice maker hose is insertable to be guided to the ice maker to be connected to the ice maker, and in which the ice maker hose, when connected to the ice maker, is accommodated. The hose guide includes a hose accommodating portion forming a space to allow the dispenser hose to be withdrawn from the hose guide by a predetermined length.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
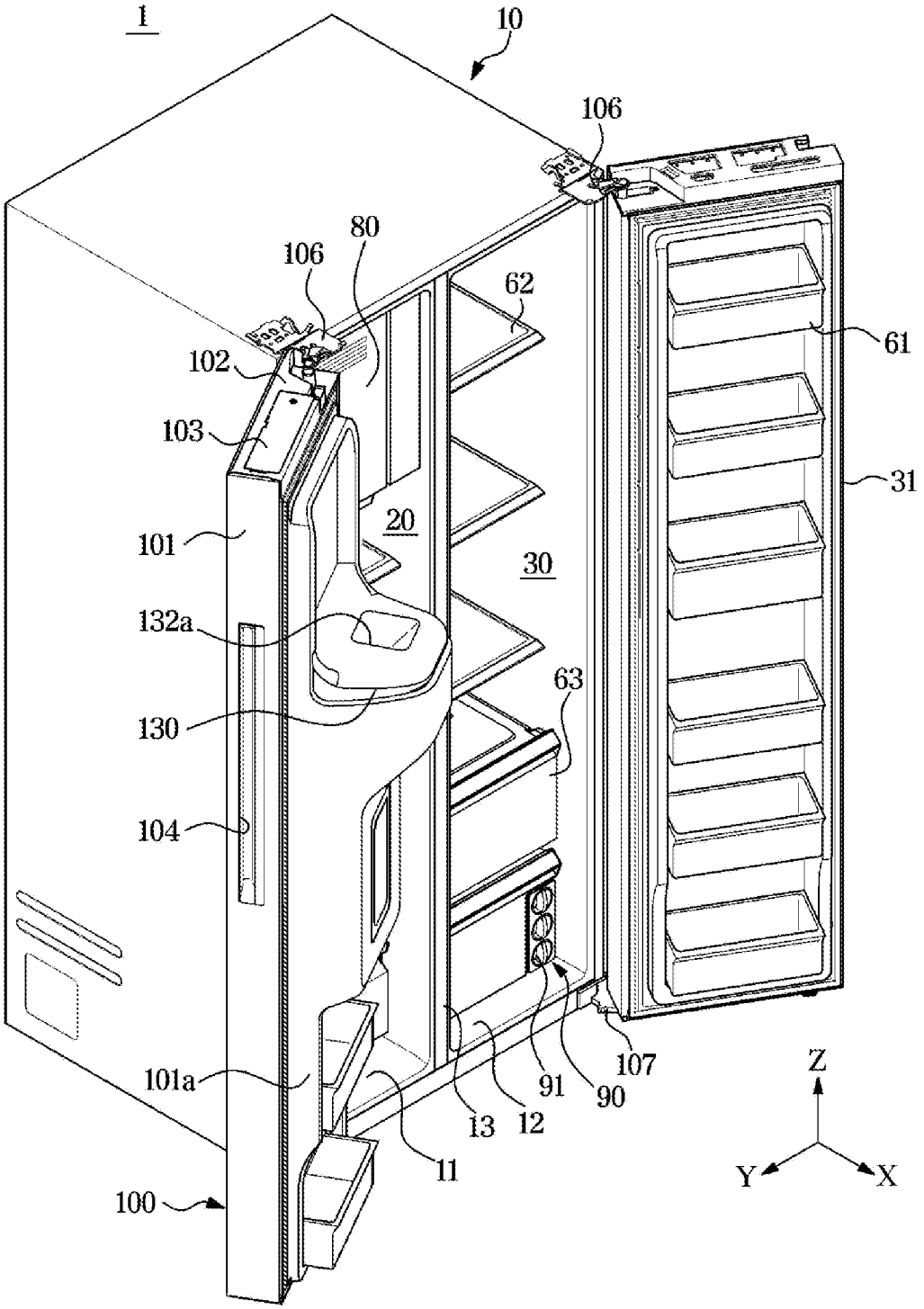
FIG. 1 is a view illustrating a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front and rear side", "upper portion", "lower portion", "left side", "right side" and the like may be defined by the drawings, but the shape and the location of the component is not limited by the term.

The disclosure will be described more fully hereinafter with reference to the accompanying drawings FIG. 1 is a view illustrating a refrigerator according to an embodiment of the disclosure.

Referring to FIG. 1, a refrigerator 1 may include a body 10, a plurality of storage compartments 20 and 30, and a plurality of doors 100 and 31 configured to open and close the plurality of storage compartments 20 and 30.

The body 10 may include a plurality of inner cases 11 and 12 and an outer case 14 disposed on the outside of the plurality of inner cases 11 and 12 to form an exterior of the refrigerator 1. Between the plurality of inner cases 11 and 12, and the outer case 14, an insulating material (not shown) may foam and be filled to prevent cold air of the plurality of storage compartments 20, and 30 from leaking to the outside of the refrigerator 1.

The plurality of inner cases 11 and 12 may include a first inner case 11 and a second inner case 12 which are adjacent in a left and right direction Y of the refrigerator 1. The first inner case 11 may be disposed on the left side of a partition wall 13 in the left and right direction Y of the refrigerator 1, and the second inner case 12 may be disposed on the right side of the partition wall 13 in the left and right direction Y of the refrigerator 1. In the partition wall 13 between the first inner case 11 and the second inner case 12, an insulating material (not shown) may foam and be filled to prevent the heat exchange between a freezing compartment 20 and a refrigerating compartment 30.

The plurality of storage compartments 20, and 30 may include the freezing compartment 20 provided in the inside of the body 10. The plurality of storage compartments 20, and 30 may include the freezing compartment 20 provided in the inside of the first inner case 11.

The plurality of storage compartments 20, and 30 may further include the refrigerating compartment 30 provided in the inside of the body 10 so as to be adjacent to the freezing compartment 20 in the left and right direction Y of the refrigerator 1. Particularly, the plurality of storage compartments 20, and 30 may further include the refrigerating compartment 30 provided in the inside of the second inner case 12.

The plurality of storage compartments 20 and 30 may include an open front surface. A plurality of shelves 62 and/or a storage box 63 may be provided in the plurality of storage compartments 20 and 30 to store food.

The storage box 63 may be provided to allow food to be placed and stored therein. The storage box 63 may be located in the refrigerating compartment 30. The storage box 63 may be withdrawn from the refrigerating compartment 30 or may be inserted into the refrigerating compartment 30. The storage box 63 may be configured to be movable in a front and rear direction X of the refrigerator 1. The storage box 63 may slide with respect to the refrigerating compartment 30.

The plurality of doors 100 and 31 may be rotatably installed on the body 10 to open and close the open front surfaces of the plurality of storage compartments 20 and 30. The plurality of doors 100 and 31 may include a freezing compartment door 100 rotatably installed on the body 10 to open and close the freezing compartment 20, and a refrigerating compartment door 31 rotatably installed on the body 10 to open and close the refrigerating compartment 30. The plurality of doors 100 and 31 may include a door insulating material (not shown) foaming and being filled inside the door to prevent the cold air of the plurality of storage compartments 20 and 30 from leaking to the outside.

A plurality of door guards 61 may be provided on a rear surface of the plurality of doors 100 and 31 to store food or the like.

A dispenser 130 may be provided on at least one of the plurality of doors 100 and 31 to allow a user to take out water or ice from the outside. Particularly, the dispenser 130 may be provided on the freezing compartment door 100.

In at least one of the plurality of storage compartments 20 and 30, an ice maker 80 configured to make ice that is to be supplied through the dispenser 130 may be provided. Particularly, the ice maker 80 may be provided in the freezing compartment 20.

The refrigerator 1 may further include a cold air supply device configured to supply cold air to the plurality of storage compartments 20 and 30. The cold air supply device may include a compressor, a condenser, an expansion valve, and an evaporator. The compressor configured to compress a refrigerant and the condenser configured to condense the compressed refrigerant may be installed in a machine room provided below the rear of the plurality of storage compartments 20 and 30.

A water supply assembly 90 may be disposed in the storage compartments 20, and 30. Particularly, the water supply assembly 90 may be disposed in the refrigerating compartment 30. However, the location of the water supply assembly 90 is not limited thereto.

The water supply assembly 90 may include a filter 91 configured to filter water that is supplied from an external water source (not shown), and a water tank (not shown) provided to store water that is filtered in the filter 91.

Figure 2:
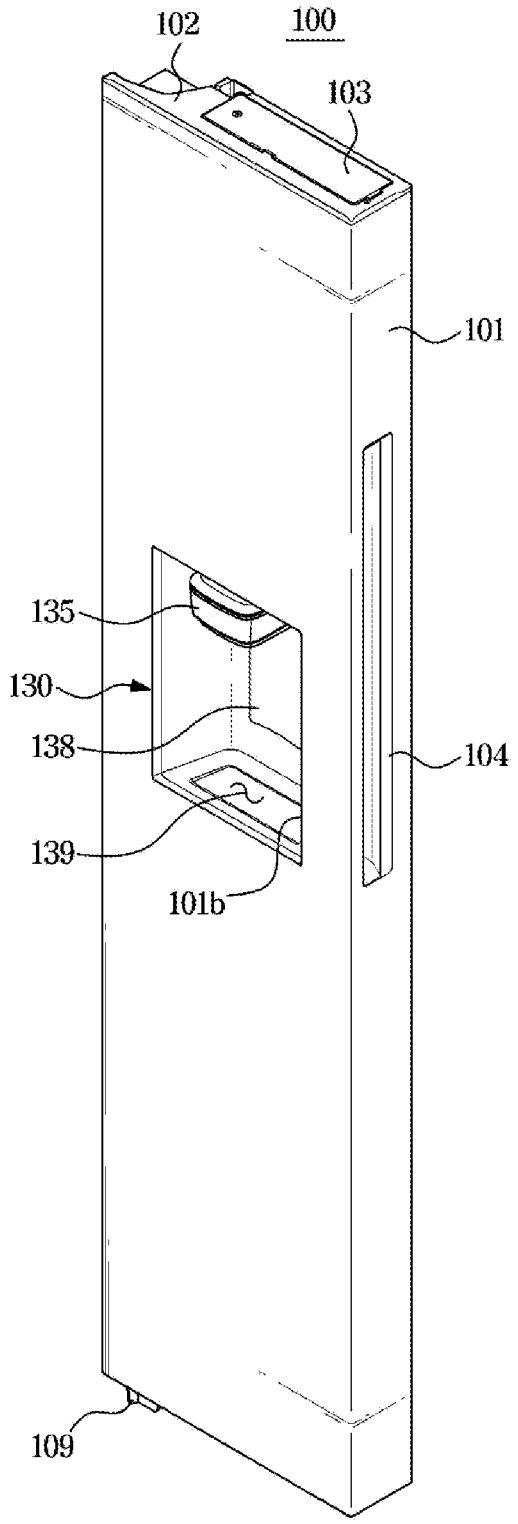
FIG. 2 is a view illustrating a freezing compartment door shown in FIG. 1.
Figure 3:
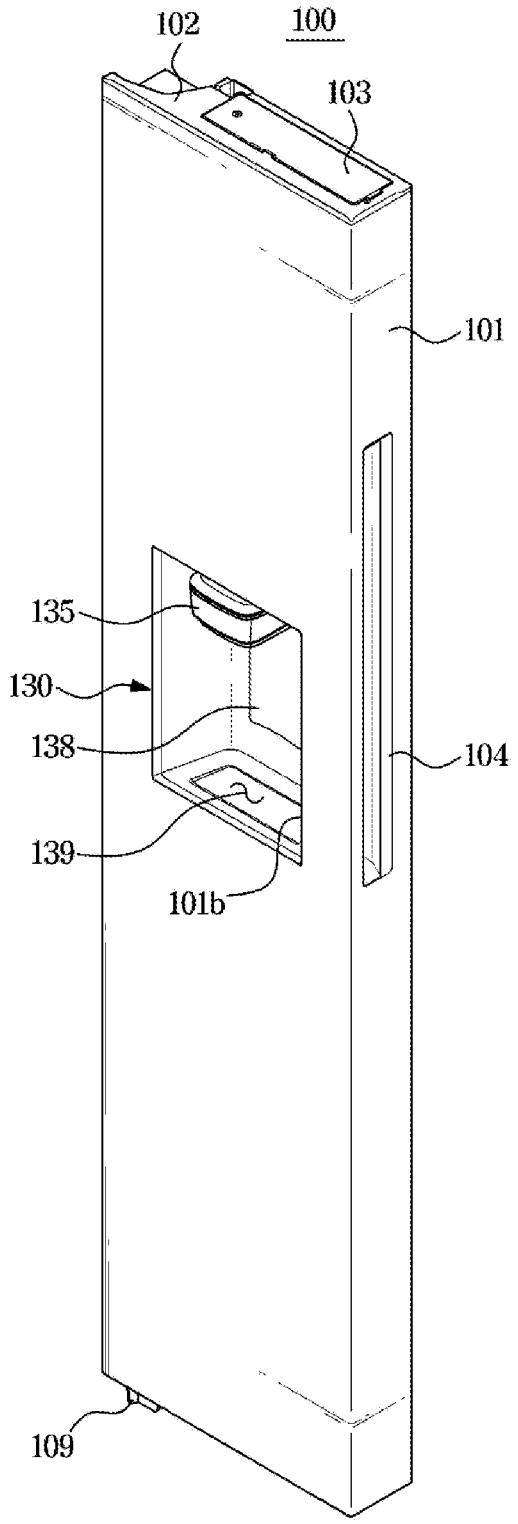
FIG. 3 is a view illustrating a hose guide provided inside the freezing compartment door shown in FIG. 2.
Figure 4:
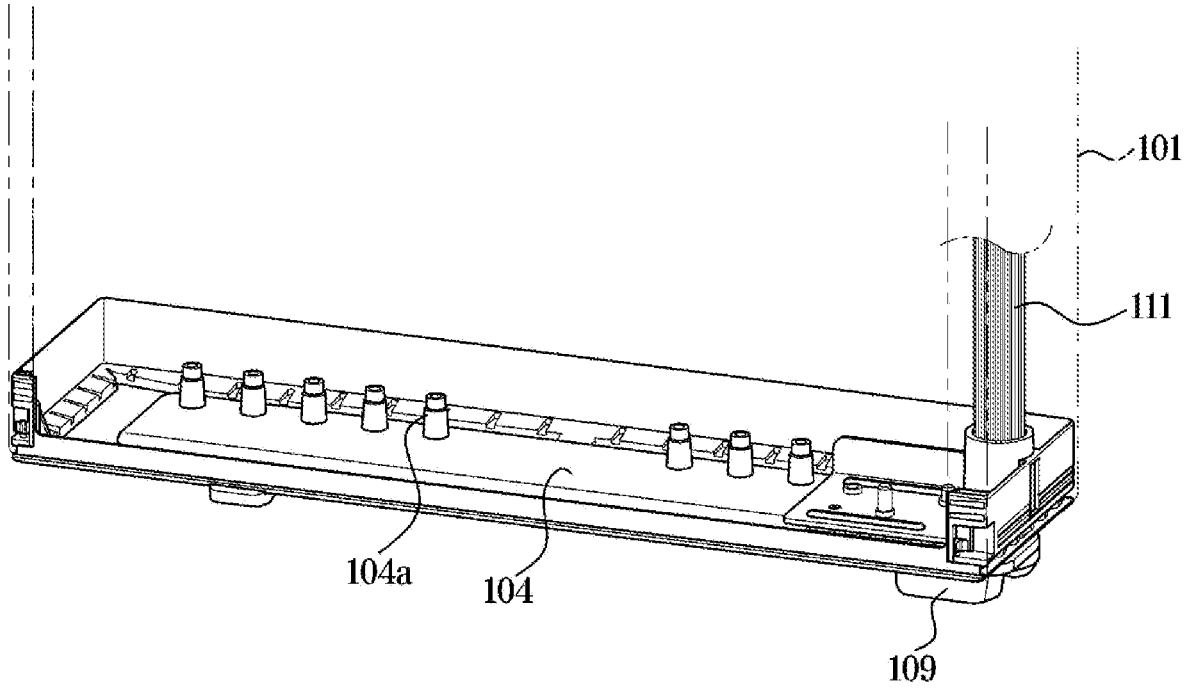
FIG. 4 is a view illustrating an inside of a lower end portion of the freezing compartment door shown in FIG. 3.
Figure 5:
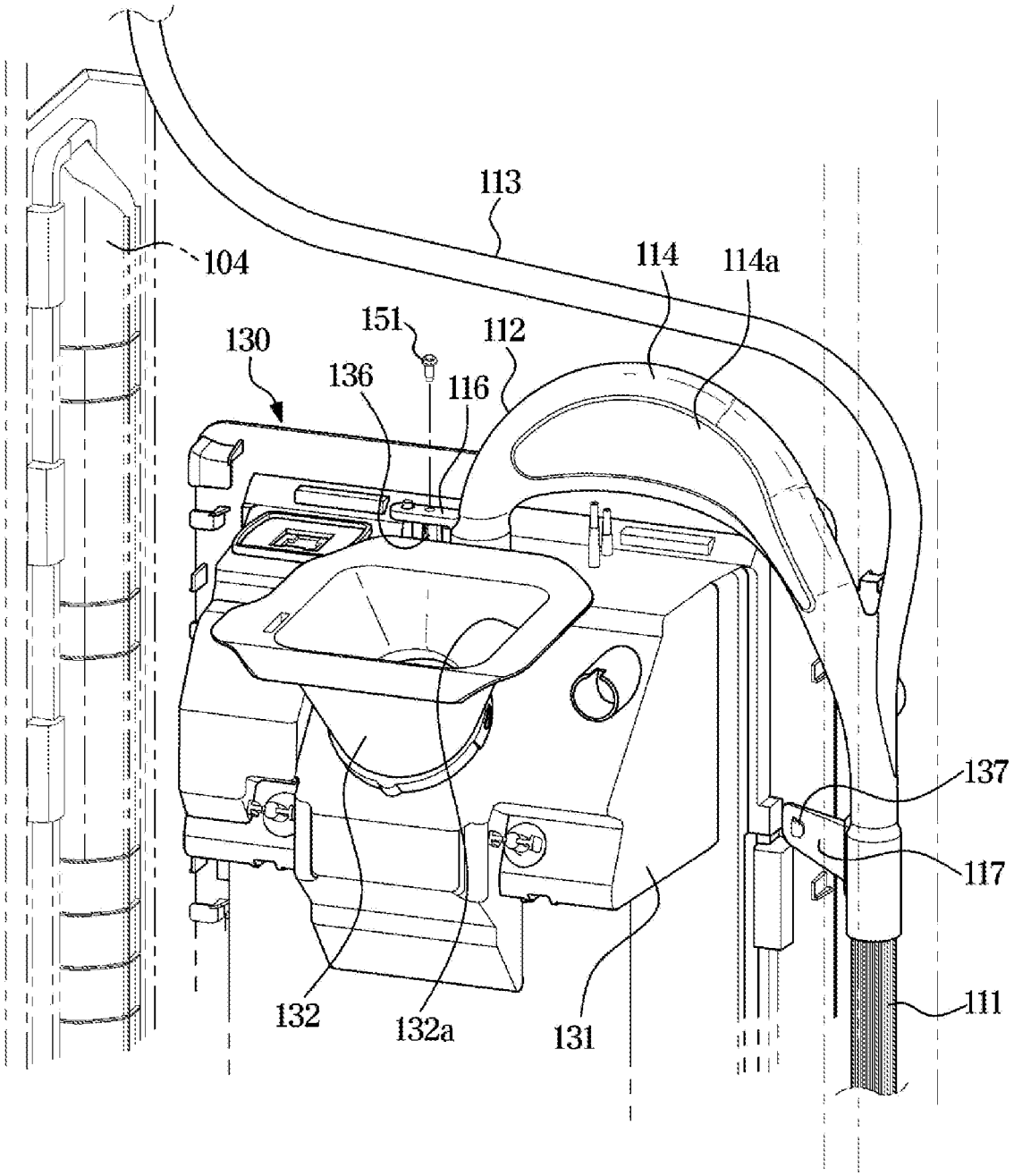
FIG. 5 is a view illustrating an inside of a portion, in which a dispenser is arranged, of the freezing compartment door shown in FIG. 3.
Figure 6:
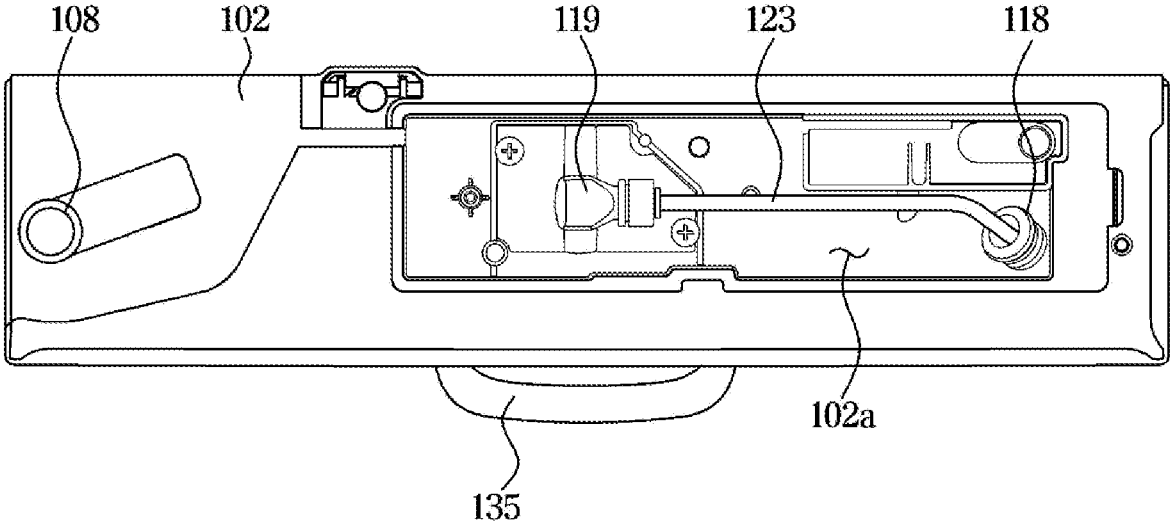
FIG. 6 is a view illustrating an upper surface of the freezing compartment door shown in FIG. 3.

FIG. 2 is a view illustrating a freezing compartment door shown in FIG. 1. FIG. 3 is a view illustrating a hose guide provided inside the freezing compartment door shown in FIG. 2. FIG. 4 is a view illustrating an inside of a lower end portion of the freezing compartment door shown in FIG. 3. FIG. 5 is a view illustrating an inside of a portion, in which a dispenser is arranged, of the freezing compartment door shown in FIG. 3. FIG. 6 is a view illustrating an upper surface of the freezing compartment door shown in FIG. 3.

For convenience of description, only the freezing compartment door 100 will be described, but the configurations described below may also be applied to the refrigerating compartment door 31. Hereinafter the freezing compartment door 100 is referred to as a door 100.

Referring to FIG. 2, the door 100 may include a door plate 101 forming an exterior. The door plate 101 may form a front surface and opposite lateral surfaces of the door 100.

A handle 104 may be formed on one lateral surface of the door plate 101. The handle 104 may be recessed from the lateral surface of the door plate 101.

Referring to FIGS. 2 and 6, an upper door cap 102 may be coupled to an upper end of the door plate 101. A cap space 102*a* may be formed inside the upper door cap 102. A portion of an ice maker hose 123 may be accommodated in the cap space 102*a*.

An upper hinge coupling portion 108 may be provided in the upper door cap 102. The upper hinge coupling portion 108 may be rotatably coupled to an upper hinge 106 installed on the body 10. The upper hinge 106 may be installed at opposite ends of the upper front side of the body 10.

Referring to FIGS. 3 and 4, a lower door cap 104 may be coupled to a lower end of the door plate 101. The lower door cap 104 may include a foam opening 104*a*. After the door plate 101, the upper door cap 102, the lower door cap 104, and an inner plate 101*a* are coupled to each other, it is possible to allow an insulating material to foam and to be filled inside the door 100 through the foaming opening 104*a*.

A lower hinge coupling portion 109 may be provided on the lower door cap 104. The lower hinge coupling portion 109 may be rotatably coupled to a lower hinge 107 installed on the body 10. The lower hinge 107 may be installed at opposite ends of the lower front side of the body 10.

A rear surface of the door plate 101 may be covered by the inner plate 101*a*. The plurality of door guards 61 may be provided on the inner plate 101*a*.

The door plate 101 may include a dispenser opening 101*b* formed on a front surface. A portion of the dispenser 130 may be exposed to the outside through the dispenser opening 101*b*. A portion of the dispenser cover 135 of the dispenser 130 and a lever 138 may be exposed to the outside through the dispenser opening 101*b*. The dispenser 130 may include an accommodation space 139 formed to accommodate a container.

Referring to FIGS. 3, 5, 7 and 9, in the inside of the door 100, a dispenser hose 122 provided to be connectable to the dispenser 130, the ice maker hose 123 provided to be connectable to the ice maker 80, and hose guides 111, 112, and 113 provided to guide the dispenser hose 122 and/or the ice maker hose 123 may be provided.

The hose guides 111, 112, and 113 may include a guide inlet portion 111, a dispenser guide portion 112, and an ice maker guide portion 113. The hose guides 111, 112, and 113 may be located inside the door 100 and may be provided to accommodate the dispenser hose 122 and/or the ice maker hose 123 therein. A door insulating material provided inside the door 100 may be provided to surround the hose guides 111, 112, and 113. That is, after the door insulating material foams inside the door 100, the hose guides 111, 112, and 113 may be fixed to the inside of the door 100, but the dispenser hose 122 and the ice maker hose 123, which are accommodated in the hose guides 111, 112, and 113, may be separable from the door 100.

Referring to FIG. 4, the guide inlet portion 111 may guide the dispenser hose 122 and the ice maker hose 123. One end of the guide inlet portion 111 may be coupled to the lower hinge coupling portion 109. The guide inlet portion 111 may be coupled to the lower hinge 107 through the lower hinge coupling portion 109.

Referring to FIG. 5, the other end of the guide inlet portion 111, which is opposite to the one end that is connected to the lower hinge coupling portion 109, may be branched into the dispenser guide portion 112 and the ice maker guide portion 113.

The dispenser guide portion 112 may be provided to guide the dispenser hose 122. The dispenser guide portion 112 may extend from the guide inlet portion 111 toward the dispenser 130. The dispenser guide portion 112 may include a hose accommodating portion 114 having an inner cross-sectional area greater than an inner cross-sectional area of the guide inlet portion 111 and/or an inner cross-sectional area of the ice maker guide portion 113.

The hose accommodating portion 114 may include a contraction preventing portion 114*a* provided to prevent contraction caused by the door insulation material filled in the door 100. The contraction preventing portion 114*a* may protrude outward from an outer side of the hose accommodating portion 114. The contraction preventing portion 114*a* may be formed in a portion of the hose accommodating portion 114 in which an area in contact with the door insulating material is relatively large. Strength of the hose accommodating portion 114 may be improved by the contraction preventing portion 114*a*, and accordingly, it is possible to prevent the hose accommodating portion 114 from being contracted caused by the insulating material that foams and is filled inside the door 100.

Figure 7:
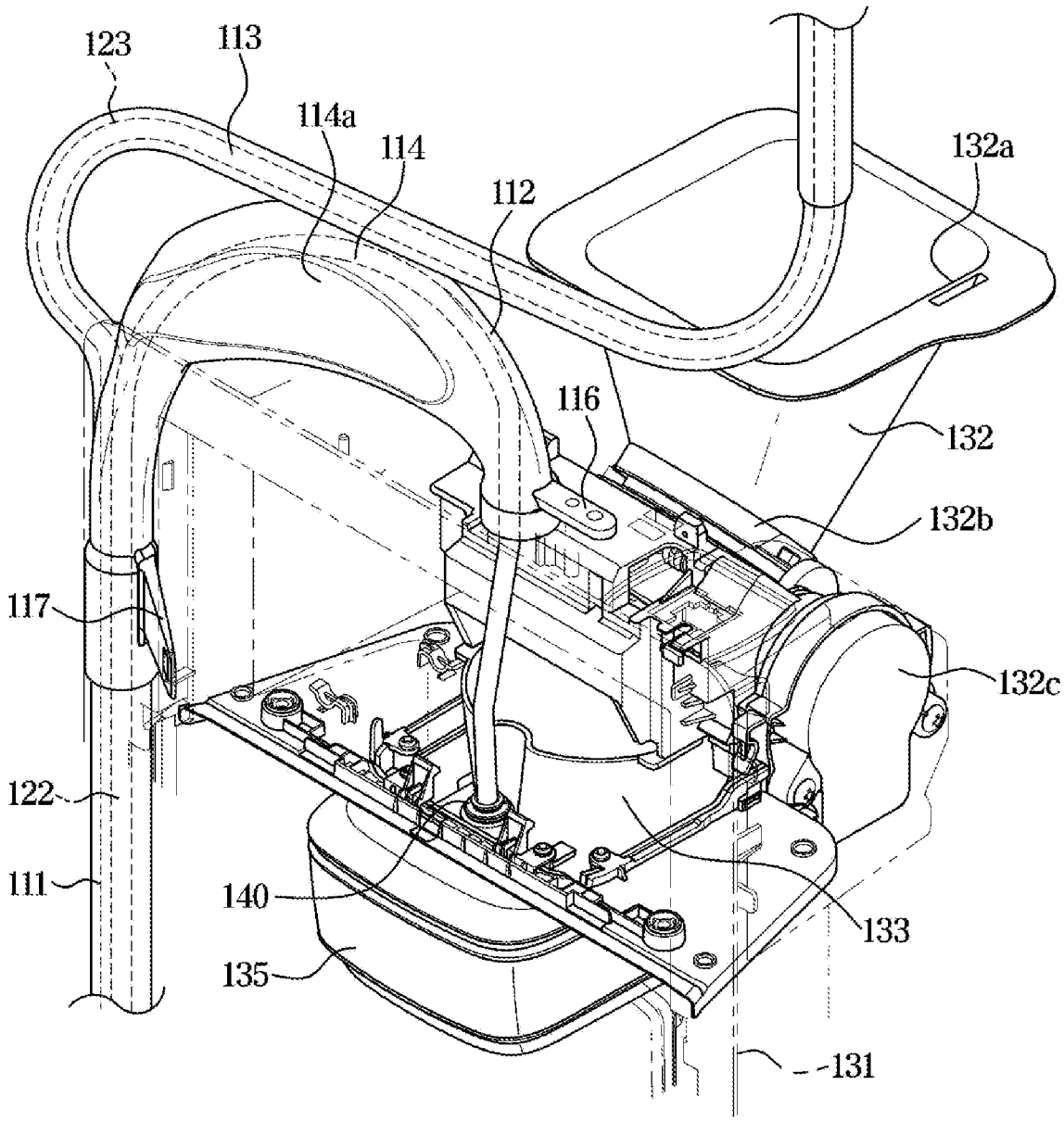
FIG. 7 is a view illustrating a state in which a dispenser hose is connected to the dispenser shown in FIG. 3.
Figure 9:
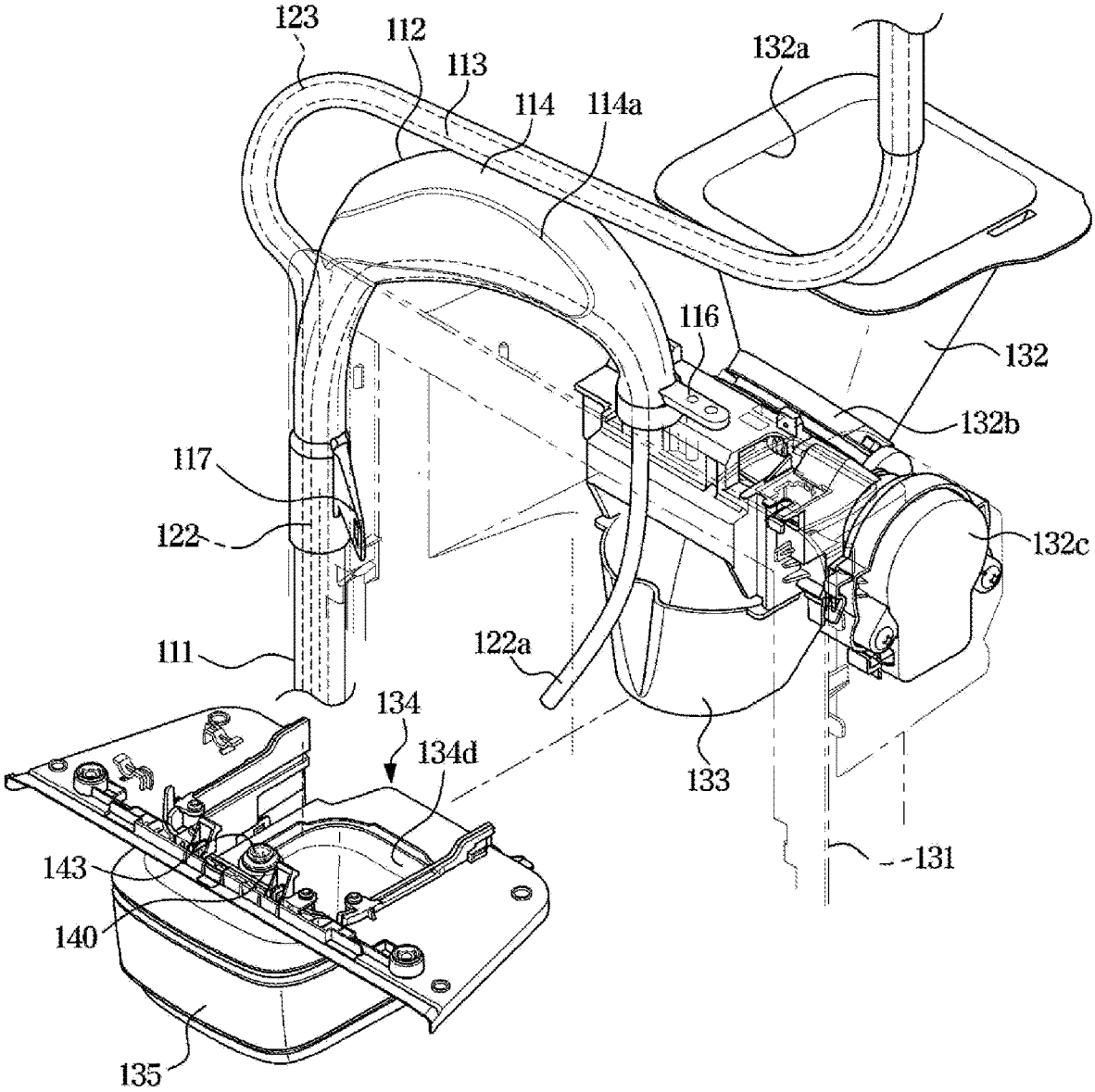
FIG. 9 is a view illustrating a state in which the dispenser cover, the connecting member and the ice guide shown in FIG. 8 are being mounted to a dispenser case and a hose is being connected to the connecting member.

The hose accommodating portion 114 may include a first accommodating portion (a lower portion of the hose accommodating portion 114, refer to FIG. 7) in which the dispenser hose 122 is accommodated in response to that the dispenser hose 122 is withdrawn from the dispenser guide portion 112 by a first length, and a second accommodating portion (an upper portion of the hose accommodating portion 114, refer to FIG. 9) in which the dispenser hose 122 is accommodated in response to that the dispenser hose 122 is withdrawn from the dispenser guide portion 112 by a second length that is less than the first length.

The dispenser guide portion 112 may be fixed to the dispenser 130. Particularly, the dispenser guide portion 112 may be fixed to a dispenser case 131 of the dispenser 130. For this, the hose guides 111, 112, and 113 may include a first coupling portion 116 coupled to one portion of the dispenser 130 and a second coupling portion 117 coupled to another portion of the dispenser 130.

The first coupling portion 116 may be coupled to a first guide coupling portion 136 formed in an upper portion of the dispenser case 131. The first coupling portion 116 may be screwed to the first guide coupling portion 136 through a first fastening member 151.

The second coupling portion 117 may be coupled to a second guide coupling portion 137 formed on one lateral surface of the dispenser case 131. The second guide coupling portion 137 may have a hook shape, and the second coupling portion 117 may be hooked to and fixed to the second guide coupling portion 137.

Referring to FIGS. 3, 5 and 6, the ice maker guide portion 113 may be provided to guide the ice maker hose 123. The ice maker guide portion 113 may extend from the guide inlet portion 111 toward the upper door cap 102 of the door 100. The ice maker guide portion 113 may be connected to an ice maker hose hole 118 formed in the upper door cap 102. The ice maker hose 123 may extend into the cap space 102*a* through the ice maker hose hole 118.

The ice maker hose 123, which extends to the cap space 102*a* of the upper door cap 102 through the ice maker hose hole 118, may be connected to an ice maker water supply device 119 of the ice maker 80. The ice maker water supply device 119 may receive water required for ice making through the ice maker hose 123.

The dispenser hose 122 may be provided to guide water to the dispenser 130. Referring to FIG. 4, the dispenser hose 122 may be provided to pass through the lower hinge coupling portion 109 and/or the lower hinge 107. For this, the guide inlet portion 111 may be connected to the lower hinge coupling portion 109 and/or the lower hinge 107. The dispenser hose 122 extending to the outside of the door 100 through the lower hinge coupling portion 109 and the lower hinge 107 may be connected to a hose (not shown), which extends from the water supply assembly 90, so as to receive water.

The dispenser hose 122 may extend from a portion, which is branched into the dispenser guide portion 112 and the ice maker guide portion 113 from the guide inlet portion 111, to the dispenser guide portion 112. The dispenser hose 122 extending along the dispenser guide portion 112 may be connected to the dispenser 130.

The ice maker hose 123 may be provided to guide water to the ice maker 80. Referring to FIG. 4, the ice maker hose 123 may be provided to pass through the lower hinge coupling portion 109 and/or the lower hinge 107. For this, the guide inlet portion 111 may be connected to the lower hinge coupling portion 109 and/or the lower hinge 107. The ice maker hose 123, which extends to the outside of the door 100 through the lower hinge coupling portion 109 and the lower hinge 107, may be connected to a hose (not shown), which extends from the water supply assembly 90, so as to receive water.

The ice maker hose 123 may extend from a portion, which is branched into the dispenser guide portion 112 and the ice maker guide portion 113 from the guide inlet portion 111, to the ice maker guide portion 113. The ice maker hose 123 extending along the ice maker guide portion 113 may extend to the cap space 102*a* of the upper door cap 102 through the ice maker hose hole 118. In the cap space 102*a* of the upper door cap 102, the ice maker hose 123 may be connected to the ice maker water supply device 119 of the ice maker 80.

Figure 8:
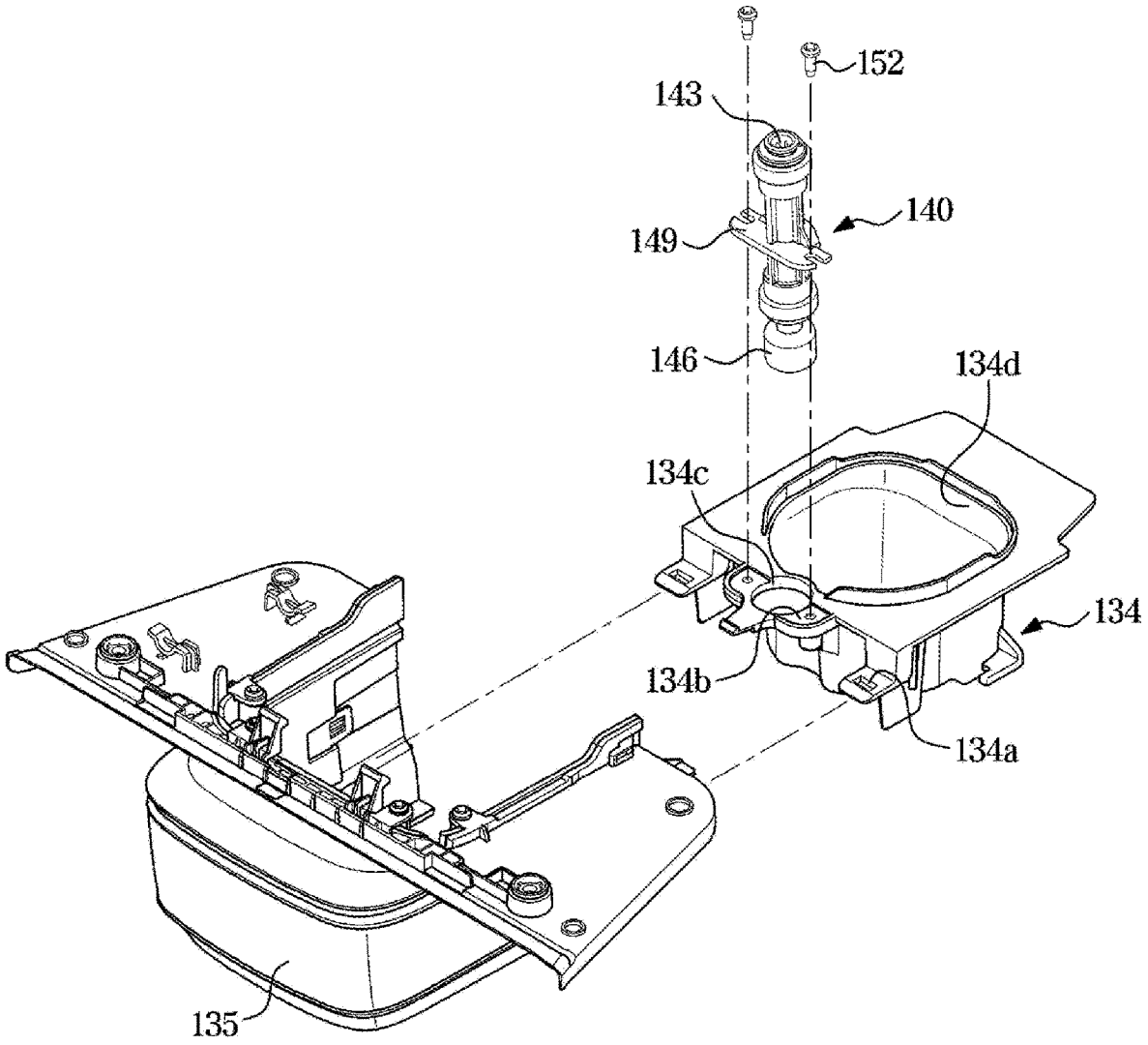
FIG. 8 is a view illustrating a state in which a dispenser cover shown in FIG. 7, a connecting member and an ice guide are being coupled to each other.

FIG. 7 is a view illustrating a state in which a dispenser hose is connected to the dispenser shown in FIG. 3. FIG. 8 is a view illustrating a state in which a dispenser cover shown in FIG. 7, a connecting member and an ice guide are being coupled to each other. FIG. 9 is a view illustrating a state in which the dispenser cover, the connecting member and the ice guide shown in FIG. 8 are being mounted to a dispenser case and a hose is being connected to the connecting member.

A process of coupling the dispenser hose 122 to the dispenser 130 of the refrigerator 1 according to an embodiment of the disclosure will be described with reference to FIGS. 7 to 9.

First, referring to FIGS. 7 and 8, the dispenser 130 may include the dispenser case 131 coupled to the rear surface of the door plate 101 of the door 100.

An ice chute 132 may be coupled to the dispenser case 131. The ice chute 132 may guide ice made in the ice maker 80 to the dispenser 130. The ice chute 132 may include a chute opening 132*a* provided to communicate with the ice maker 80.

The ice chute 132 may include a chute opening and closing member 132*b* configured to open and close an opening provided to communicate with the dispenser case 132. The chute opening and closing member 132*b* may be driven by a chute driving device 132*c*.

A first ice guide 133 may be mounted on the dispenser case 131. The first ice guide 133 may guide the ice transmitted from the ice chute 132 to a second ice guide 134.

The dispenser case 131 may include the second ice guide 134 disposed under the first ice guide 133. The second ice guide 134 may guide the ice transmitted from the first ice guide 133 to the accommodation space 139 of the dispenser 130. For this, the second ice guide 134 may include a guide opening 134*d*.

The second ice guide 134 may include a cover coupling portion 134*a* coupled to the dispenser cover 135. The cover coupling portion 134*a* may be coupled to the dispenser cover 135 in a hook manner.

The second ice guide 134 may include a guide fixing portion 134*b* to which a connecting member 140 is fixed. In the guide fixing portion 134*b*, a connecting member insertion hole 134*c* into which the connecting member 140 is inserted may be formed.

The dispenser cover 135 may be coupled to the dispenser case 131. The dispenser cover 135 may cover the inside of the dispenser 130.

The connecting member 140 may be mounted on the second ice guide 134. The connecting member 140 may include a connecting member fixing portion 149. The connecting member fixing portion 149 may be fixed to the guide fixing portion 134*b* of the second ice guide 134 by a second fastening member 152.

One end of the connecting member 140 may be connected to the dispenser hose 122. A cock 146 may be detachably coupled to the other end of the connecting member 140 opposite to the one end.

Referring to FIG. 9, the dispenser hose 122 may include a dispenser connecting portion 122*a* fixed to the dispenser 130. The dispenser connecting portion 122*a* may be an end portion of the dispenser hose 122 close to the dispenser 130.

The hose accommodating portion 114 may form a space to allow the dispenser hose 122 to be withdrawn from the dispenser guide portion 112 by a predetermined length. Particularly, for ease of operation of connecting the dispenser hose 122 to the connecting member 140 of the dispenser 130, the dispenser connecting portion 122*a* of the dispenser hose 122 may be withdrawn from the dispenser guide portion 112 as far as possible. That is, in order to easily couple the dispenser hose 122 to the dispenser 130, the dispenser hose 122 may be withdrawn from the dispenser guide 112 by a length longer than necessary. Accordingly, a portion of the dispenser hose 122 positioned in the hose accommodating portion 114 is positioned in the lower portion of the hose accommodating portion 114.

Next, referring to FIG. 7, in response to mounting the dispenser cover 135 and the second ice guide 134 to the dispenser case 131 after coupling the dispenser connecting portion 122*a* of the dispenser hose 122 to the connecting member 140, the dispenser hose 122, which is withdrawn by a length longer than necessary, may be brought back into the dispenser guide portion 112. At this time, in the conventional manner, the dispenser hose 122 may be bent or twisted upon being brought back into the dispenser guide portion 112 because the hose accommodating portion 114 is not provided. However, in the refrigerator 1 according to an embodiment of the disclosure, the hose accommodating portion 114 may be provided in the dispenser guide portion 112, and thus the dispenser hose 122 may be accommodated in the hose accommodating portion 114 without being bent or twisted in response to being inserted into the dispenser guide portion 112.

In addition, in the refrigerator 1 according to an embodiment of the disclosure, the dispenser connecting portion 122*a* of the dispenser hose 122 may be coupled to the connecting member 140, and the cock 146 may be removably provided in the other end of the connecting member 140, thereby reducing the material cost in comparison with the conventional manner in which the dispenser hose 122 extends to the accommodation space 139 of the dispenser 130 and an unnecessary portion is cut out.

Figure 10:
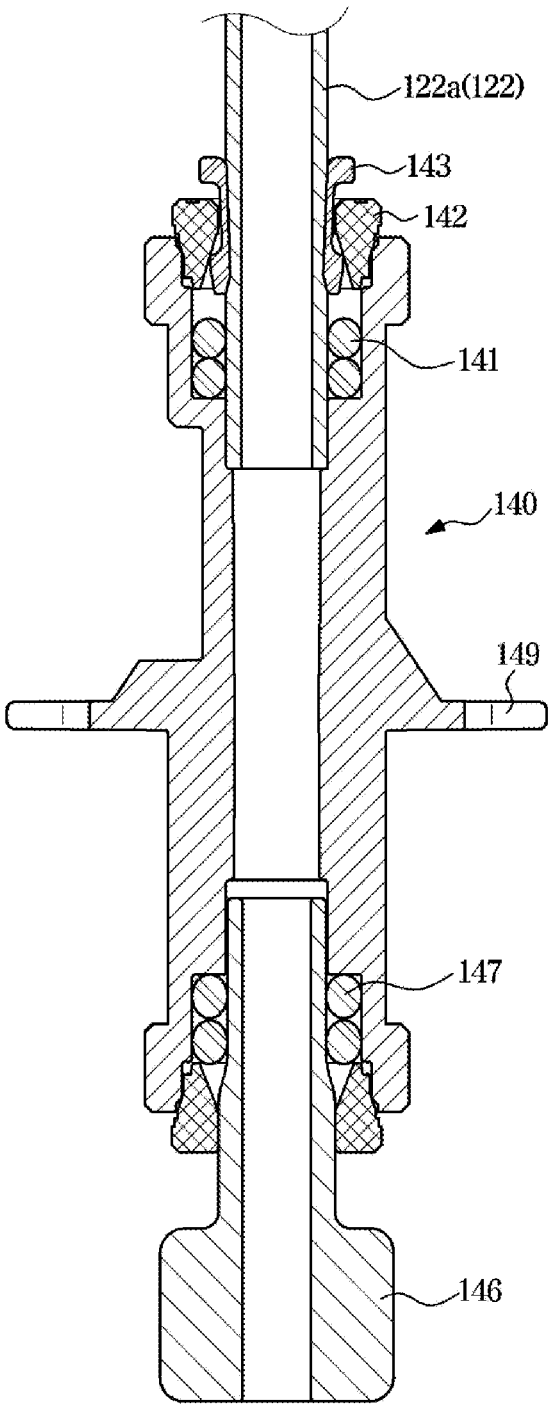
FIG. 10 is a cross-sectional view illustrating a state in which the dispenser hose and a cock are coupled to the connecting member shown in FIG. 7.
Figure 11:
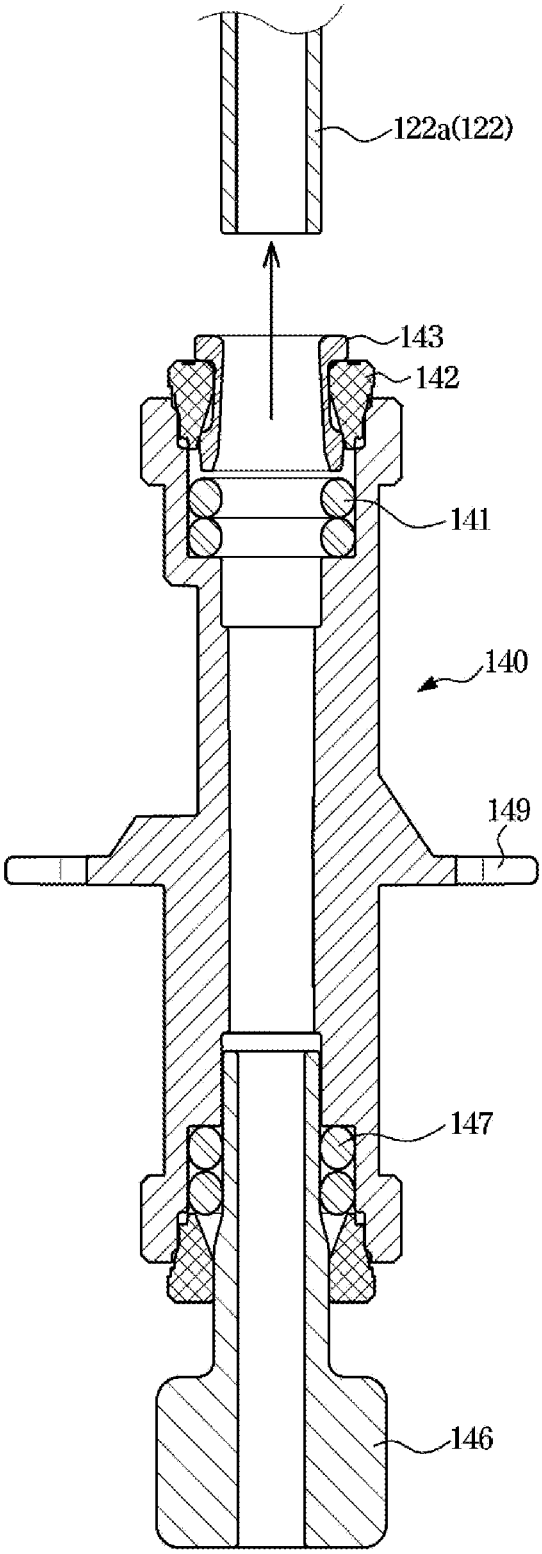
FIG. 11 is a view illustrating a state in which the dispenser hose is separated from the connecting member shown in FIG. 10.
Figure 12:
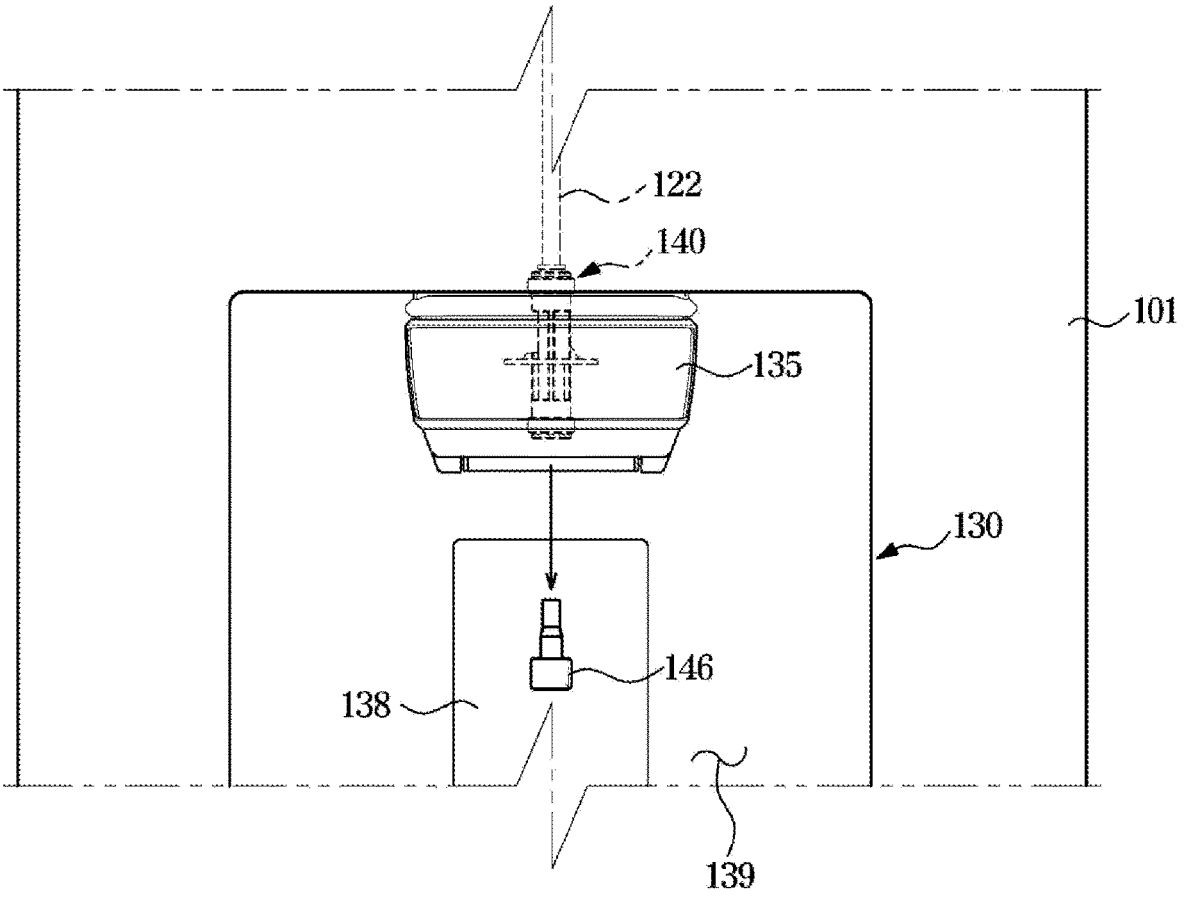
FIG. 12 is a view illustrating a state in which the cock is separated from the dispenser shown in FIG. 3.

FIG. 10 is a cross-sectional view illustrating a state in which the dispenser hose and a cock are coupled to the connecting member shown in FIG. 7. FIG. 11 is a view illustrating a state in which the dispenser hose is separated from the connecting member shown in FIG. 10. FIG. 12 is a view illustrating a state in which the cock is separated from the dispenser shown in FIG. 3.

The cock 146 detachably mounted on the connecting member 140 of the dispenser 130 of the refrigerator 1 according to an embodiment of the disclosure will be described with reference to FIGS. 10 to 12. For convenience of description, although the cock 146 according to an embodiment of the disclosure is shown to be applied to a side by side (SBS) type refrigerator 1, the cock 146 according to an embodiment of the disclosure is not limited to the type of refrigerator. In addition, the cock 146 according to an embodiment of the disclosure may be applied to any type of refrigerator as long as including a dispenser. In addition, the cock 146 is a component separated from the above-mentioned hose guides 111, 112 and 113 and thus the cock 146 may be applied to a refrigerator in which the hose guides 111, 112 and 113 are not provided.

The dispenser 130 includes the connecting member 140 provided to connect the dispenser hose 122 to the cock 146.

The connecting member 140 is provided such that one end of the dispenser hose 122 may be fixed to the dispenser connecting portion 122*a*.

Particularly, the connecting member 140 may include a first hose fixing member 141 provided to fix the dispenser hose 122 by an elastic force. The first hose fixing member 141 may be provided as an O-ring. The first hose fixing member 141 may seal between the connecting member 140 and the dispenser hose 122.

The connecting member 140 may include a second hose fixing member 143 provided to selectively fix the dispenser hose 122. The second hose fixing member 143 may be configured to release the dispenser hose 122 in response to pressing the second hose fixing member 143 to the direction in which the dispenser hose 122 is inserted into the connecting member 140.

Particularly, referring to FIG. 10, the second hose fixing member 143 is provided in such a way that one end thereof close to the first hose fixing member 141 is elastically biased in a direction of fixing the dispenser hose 122.

Referring to FIG. 11, in response to pressing the second hose fixing member 143 to the direction in which the dispenser hose 122 is inserted into the connecting member 140, one end portion of the second hose fixing member 143 close to the first hose fixing member 141 is opened. Accordingly, the dispenser hose 122 is released. An operation of the second hose fixing member 143 may be guided by the fixing guide portion 142.

Referring to FIGS. 10 to 12, the cock 146 according to an embodiment of the disclosure may be provided to be separable from the connecting member 140. The cock 146 may be formed of stainless steel. The connecting member 140 may include a cock fixing member 147 provided to removably fix the cock 146. The cock fixing member 147 may fix the cock 146 by an elastic force. The cock fixing member 147 may be provided as an O-ring.

Referring to FIG. 12, in a case in which the cock 146 of the dispenser 130 is contaminated, a user can easily separate the cock 146 from the connecting member 140 and then clean the cock 146. Accordingly, in the refrigerator 1 according to an embodiment of the disclosure, the cleanliness of the dispenser 130 may be improved.

As is apparent from the above description, it is possible to easily replace the water supply hose even after the insulating material is filled in the door, because the refrigerator is provided with the hose guide provided inside the door so as to guide the water supply hose.

It is not required to cut out a remaining portion of the hose after mounting the hose to the dispenser because the hose accommodation portion is provided in the hose guide, and thus it is possible to reduce the material cost.

The refrigerator may be provided in such a way that the cock is separable from the cock device of the dispenser and thus it is possible to clean the cock when the cock is contaminated. Therefore, it is possible to improve the cleanliness of the dispenser.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body forming a storage compartment;

a door to open and close the storage compartment;

a dispenser hose;

a dispenser in the door and including:

a connecting member having one end connectable to the dispenser hose so that water is guidable to the dispenser by the dispenser hose, and a cock removably coupled to an other end of the connecting member opposite to the one end of the connecting member; and a hose guide, inside the door, through which the dispenser hose is insertable to be guided to the dispenser to be connected to the one end of the connecting member, and in which the dispenser hose, when connected to the one end of the connecting member, is accommodated.

2. The refrigerator of claim 1, wherein the connecting member includes:

a hose fixing member configured to release the dispenser hose in response to the hose fixing member being pressed toward a direction opposite to a direction from which the dispenser hose is released from the connecting member.

3. The refrigerator of claim 2, wherein the hose fixing member is a first fixing member, and the connecting member includes:

a second hose fixing member to fix the dispenser hose by an elastic force.

4. The refrigerator of claim 1, wherein the connecting member includes a cock fixing member to fix the cock by an elastic force.

5. The refrigerator of claim 1, wherein the cock is formed of stainless steel.

* * * * *